US005979466A

United States Patent [19]

Chung

[11] Patent Number: 5,979,466

[45] Date of Patent: Nov. 9, 1999

[54] BARRETTE

[75] Inventor: Wen-Chien Chung, Tainan, Taiwan

[73] Assignee: Chian Tai Attire Enterprise Co., Ltd., Tainan, Taiwan

[21] Appl. No.: 09/305,366

[22] Filed: May 5, 1999

[51] Int. Cl.[6] ..... A45D 8/14

[52] U.S. Cl. ..... 132/275; 132/273; 2/171

[58] Field of Search ..... 132/273, 275, 132/276, 277, 278, 279; D28/39, 41, 33; 2/171, 174, 182.6, 182.1, DIG. 11

[56] References Cited

U.S. PATENT DOCUMENTS 5,692,243 12/1997 Chang ..... 2/171
5,822,798 10/1998 Baxley ..... 2/182.6
5,826,597 10/1998 Chou ..... 132/273
5,829,457 11/1998 Huang ..... 132/275
5,913,316 6/1999 Chou ..... 132/275

*Primary Examiner*—Gene Mancene
*Assistant Examiner*—Pedro Philogene
*Attorney, Agent, or Firm*—Rosenberg, Klein & Bilker

[57] ABSTRACT

A barrette consists of a decorative elongate chain-shaped frame and a decorative elongate strip inserting up and down through decorative holes continually provided in the frame and resting on an upper or lower surface of contact walls separating each two decorative holes of the frame. The frame and the strip may have the same length and width but different colors from each other.

3 Claims, 4 Drawing Sheets

BARRETTE

BACKGROUND OF THE INVENTION

This invention relates to a barrette, particularly to one having a decorative plate inserted through a chain-shaped decorative frame, having a new style.

Generally barrettes are widely used by the female for arranging and positioning their hairs, and quite a large kinds of barrettes are in use, but mostly used ones may be C-shaped painted with lacquer or ground smooth on the surface, with few varieties.

SUMMARY

This invention has been devised to offer a kind of barrette consisting of a decorative elongate plate and a decorative chain-shaped frame for the decorative elongate plate to insert up and down through plural decorative holes of the decorative chain-shaped frame, presenting new variety of barrettes.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
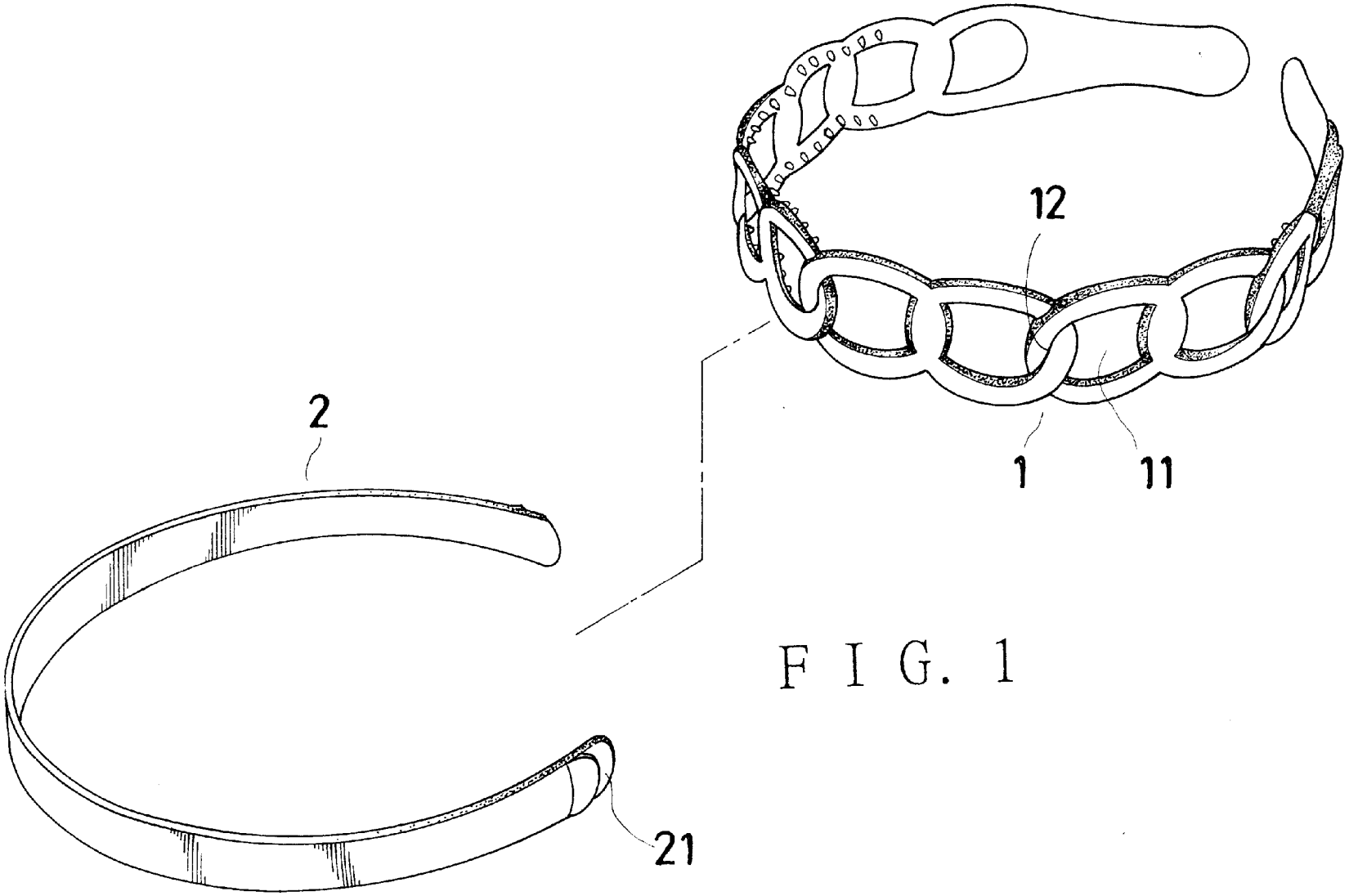
FIG. 1 is an exploded perspective view of a barrette of the present invention.

A preferred embodiment of a barrette of the present invention, as shown in FIG. 1, includes a decorative elongate chain-shaped frame 1 and a decorative elongate strip 2 combined together.

The decorative elongate chain-shaped frame 1 is C-shaped, to be worn on the head of a user, having a plurality of decorative holes 11 abutting on each other, with a contact section 12 formed between each two neighboring decorative holes 11. The decorative holes 11 are for the decorative elongate strip 2 to insert through up and down.

The decorative elongate strip 2 has almost the same length and width as the decorative elongate chain-shaped frame 1, and a two-stage engage end 21 respectively formed at two ends.

Figure 4:
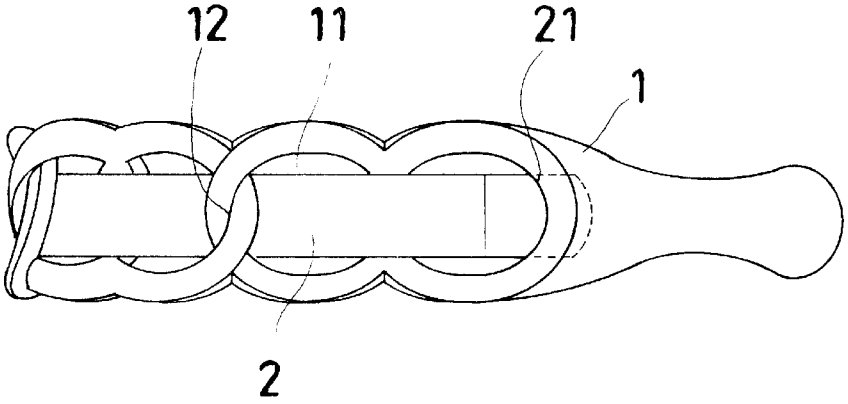
FIG. 4 is a side view of the barrette combined of the present invention.
Figure 2:
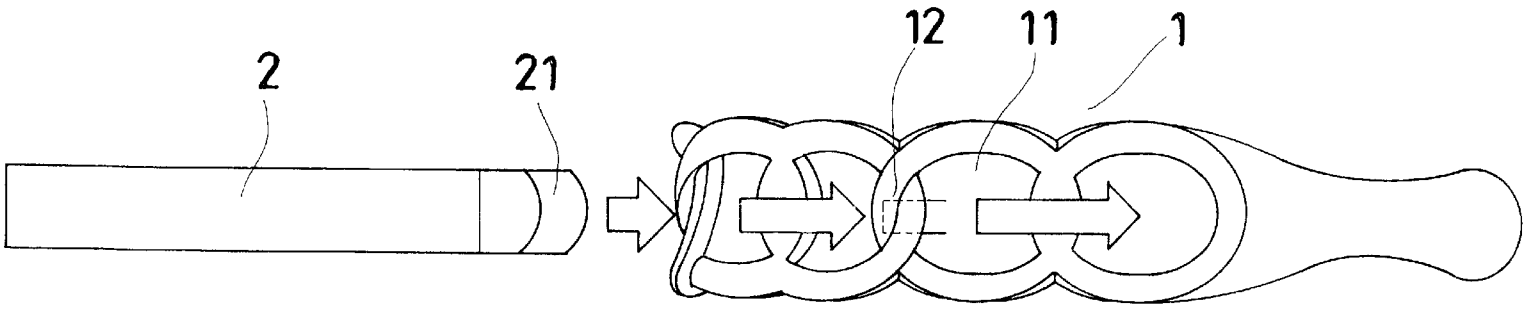
FIG. 2 is a side view of the barrette being combined of the present invention.
Figure 3:
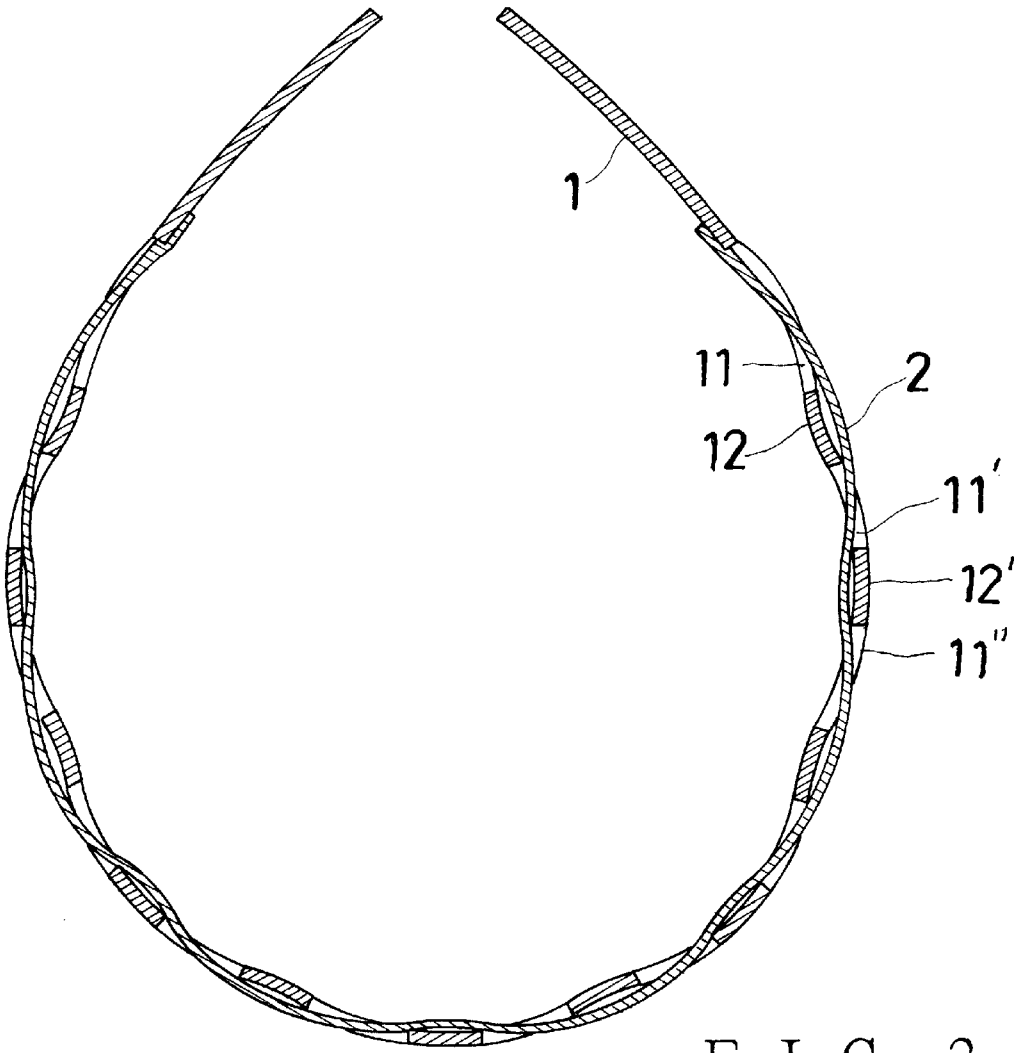
FIG. 3 is an upper view of the barrette combined of the present invention.
Figure 5:
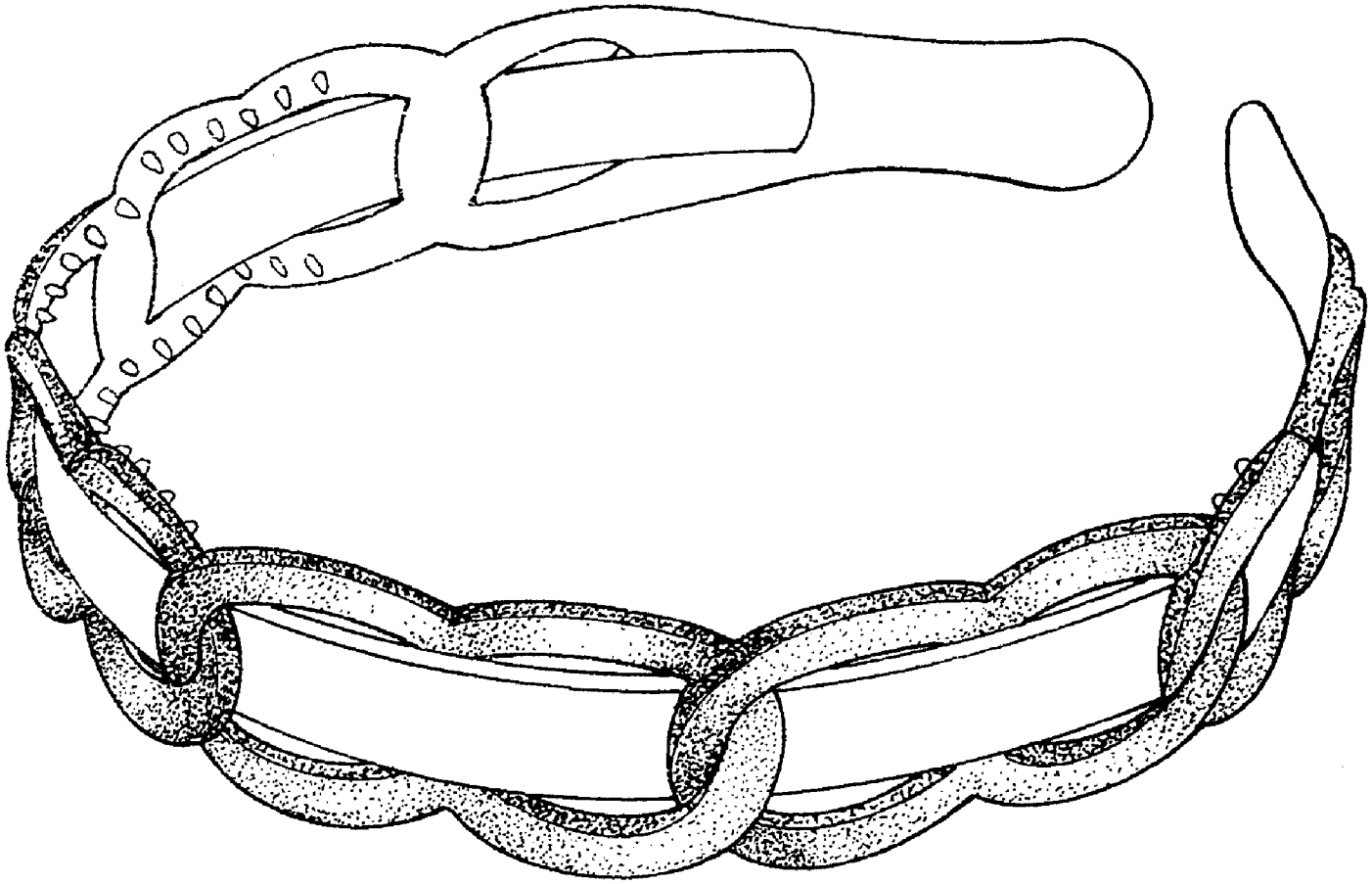
FIG. 5 is a perspective view of the barrette of the present invention.

In combining, as shown in FIGS. 2 and 3, one end of the decorative elongate strip 2 is inserted through the outer most hole 11 of the decorative elongate chain-shaped frame 1 and then passes over one of the contact section 12 and then through the next hole 11' down to pass over another contact section 12' and then to insert through the third hole 11" up, and so on, until the two engage ends 21 may respectively engage with the two outer most holes 11 of the decorative chain-shaped frame 1 as shown in FIGS. 4 and 5, forming the barrette in the invention.

In addition, the decorative elongate chain-shaped frame 1 may be used independently as a barrette, and also be combined with the decorative elongate strip 2, which is inserted up and down through the decorative holes 11 to present various visual effect by adding various colors on the surface of the decorative elongate chain-shaped frame 1 and of the decorative elongate strip 2. Then consumers can be attracted by brand new eye-catching appearance of the barrette in the invention.

What is claimed is:

1. A barrette comprising a decorative elongate chain-shaped frame and a decorative elongate strip, said decorative elongate chain-shaped frame having a plurality of decorative holes abutting on each other and separated by a contact section between each two of said holes, said decorative elongate strip having the same length and width as said decorative elongate chain-shaped frame and inserting up and down through said decorative holes of said frame and resting on an upper or lower surface of said contact sections, forming an unusual attractive shape of a barrette.

2. The barrette as claimed in claim 1 wherein said decorative elongate strip has two ends formed as two-staged to engage the two outermost decorative holes of said decorative elongate chain-shaped frame.

3. The barrette as claimed in claim 1, wherein said decorative elongate chain-shaped frame and said decorative elongate strip are colored differently from each other.

* * * * *